US006189170B1

(12) United States Patent
Sherwood

(10) Patent No.: US 6,189,170 B1
(45) Date of Patent: Feb. 20, 2001

(54) AREA RUG CLEANING METHOD

(76) Inventor: Ronald E. Sherwood, 4440 Curry Ford Rd., Orlando, FL (US) 32812

( * ) Notice: Under 35 U.S.C. 154(b), the term of this patent shall be extended for 0 days.

(21) Appl. No.: 09/373,160

(22) Filed: Aug. 12, 1999

(51) Int. Cl.[7] ..... D06S 5/24
(52) U.S. Cl. ..... 8/158; 15/321
(58) Field of Search ..... 8/148, 150; 15/321, 15/320, 322

(56) References Cited

U.S. PATENT DOCUMENTS

| | | | | |
|---|---|---|---|---|
| D. 384,466 | | 9/1997 | Taylor | D34/23 |
| 3,756,728 | * | 9/1973 | Delaughter . | |
| 3,919,729 | * | 11/1975 | Cannan . | |
| 4,168,563 | * | 9/1979 | O' Bryan . | |
| 4,216,563 | * | 8/1980 | Cyphert . | |
| 4,353,145 | * | 10/1982 | Woodford . | |
| 4,453,386 | | 6/1984 | Wilkins | 68/19.1 |
| 4,552,692 | * | 11/1985 | Gillespie . | |
| 5,322,078 | | 6/1994 | Tuttle | 134/104.4 |
| 5,349,974 | | 9/1994 | Mansur | 134/107 |
| 5,413,131 | | 5/1995 | Medlock | 134/104.4 |
| 5,470,477 | | 11/1995 | Farnsworth | 210/634 |

* cited by examiner

*Primary Examiner*—Frankie L. Stinson
(74) *Attorney, Agent, or Firm*—Edward M. Livingston, Esq.

(57) ABSTRACT

An area-rug cleaning method has steps of air spray (1) for removing dry-extractible dirt with angularly directed air pressure; immersion shampoo (9) for removing immersion-extractible dirt with immersion-shampooing that does not molest rug fibers; scrub wash (16) for removing adhered dirt such as stains, odors and urine with rotational scrub washing; vacuum extract (18) for removing wash fluid with dry vacuum extraction; water rinse (20); cool dry (23); dry clean (24) for removing wash-resistant dirt; acid condition (25) for neutralizing base cleaning agents with an acid-based catalyst; and pad rub (26) for rubbing nap of the area rugs with a cloth pad to provide a shine finish.

23 Claims, 3 Drawing Sheets

AREA RUG CLEANING METHOD

BACKGROUND OF THE INVENTION

This invention relates to a method for commercially cleaning area rugs such as throw rungs and oriental rugs.

There are known methods, systems and apparatuses for commercially cleaning area rugs, but none that teach the effectiveness, convenience, rug protection and low cost made possible by this invention.

An example of a different method and an apparatus is described in U.S. Pat. No. 4,453,386, issued to Wilkins on Jun. 12, 1984. With the Wilkins system, rugs are positioned upside down on a conveyor belt and sprayed angularly upward into carpet fiber and downward onto carpet backing with cleaning fluid from a plurality of diversely directed nozzles for dirt removal, rinsing and drying while the rugs are being conveyed across a top of a plurality of successively washing and drying portions of a rectangular tank. Wilkins taught a general-purpose rug-washing system that does not allow sufficient flexibility of professional cleaning techniques required for different types of rugs. Nor does it provide sufficient dry particle removal, washing action, deodorizing, dry cleaning and fabric conditioning for most types of rugs. It has limited effectiveness for some types of rugs and is damaging to others.

SUMMARY OF THE INVENTION

Objects of patentable novelty and utility taught by this invention are to provide a rug-cleaning method which:

- provides for application of required select professional knowledge for cleaning all types of rugs by commercial rug cleaners;
- removes all types of dirt, odors and stains effectively from all portions of all types of rugs;
- protects rug nap, backing and fringes; and
- reconditions rug materials.

This invention accomplishes these and other objectives with a rug-cleaning method having steps of first removing dry particles with a pressurized angular blower that removes forms and concentrations of particulate which can be removed most effectively dry than wet and which would deter effective cleaning with liquid cleaning agents first. Second is immersion shampooing in a tank of shampoo solution that is agitated, strained, circulated, flushed and replaced repeatedly as appropriate to remove a major portion of dissolved and undissolved dirt that is removable without scrubbing or rubbing. Third, while the rug is still wet and soaked from the shampoo, is scrub washing rotationally while deodorizing with a detergent solution that is selected from classes and types of cleaning agents for removal of relatively adherent contaminants such as urine, food stains, rust, oils and other common dirt that may be detected in particular rugs. Fourth is water rinsing top, bottom and any fringe. Fifth is vacuuming top, bottom and any fringe with an extractor. Sixth is drying at approximately 70 to 75 degrees Fahrenheit. Seventh is spray dry cleaning with a water-miscible solvent. Eighth is conditioning with an acid-based dry-cleaning catalyst. Finally, a ninth step is rubbing with a rotating cloth pad before the dry-cleaning catalyst is fully dry.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are described briefly as follows:

DESCRIPTION OF PREFERRED EMBODIMENT

Listed numerically below with reference to the drawings are terms used to describe features of this invention. These terms and numbers designate the same features throughout this description.

| | |
|---|---|
| 1. Air spray | 33. Tank rack |
| 2. Rug | 34. Air-spray section |
| 3. Nap | 35. Automated nozzle tubes |
| 4. Backing | 36. Vacuum hood |
| 5. Fringes | 37. Shampoo section |
| 6. Sprays of air | 38. Immersion tank |
| 7. Nozzles | 39. Shampoo wringer |
| 8. Nozzle tube | 40. Scrub-wash section |
| 9. Immersion shampoo | 41. Automated scrubbers |
| 10. Shampoo tank | 42. Vacuum section |
| 11. Shampoo-liquid line | 43. Automated vacuum |
| 12. Inlet conveyance | 44. Water-rinse section |
| 13. Circulator | 45. Automated rinse tank |
| 14. Agitator tube | 46. Water-rinse wringer |
| 15. Drain conveyance | 47. Cool-dry section |
| 16. Scrub wash | 48. Automated blow dryer |
| 17. Rotary scrubbing brush | 49. Blow-dryer hood |
| 18. Vacuum extract | 50. Dry-clean section |
| 19. Extractor vacuum | 51. Automated dry cleaner |
| 20. Water rinse | 52. Acid-condition section |
| 21. Rinse tank | 53. Conditioner tank |
| 22. Rinse-water conveyance | 54. Conditioning wringer |
| 23. Cool dry | 55. Pad-rub section |
| 24. Dry clean | 56. Automated rubbing machine |
| 25. Acid condition | 57. Top roller |
| 26. Pad rub | 58. Roller fingers |
| 27. Cloth pad | 59. Bottom roller |
| 28. Rotational rubbing machine | 60. Elongate spaces |
| 29. Roundness orifices | 61. Support belts |
| 30. Flatness orifices | 62. Strainer |
| 31. Slanted handle | |
| 32. Nozzle-tube wheels | |

Figure 1:
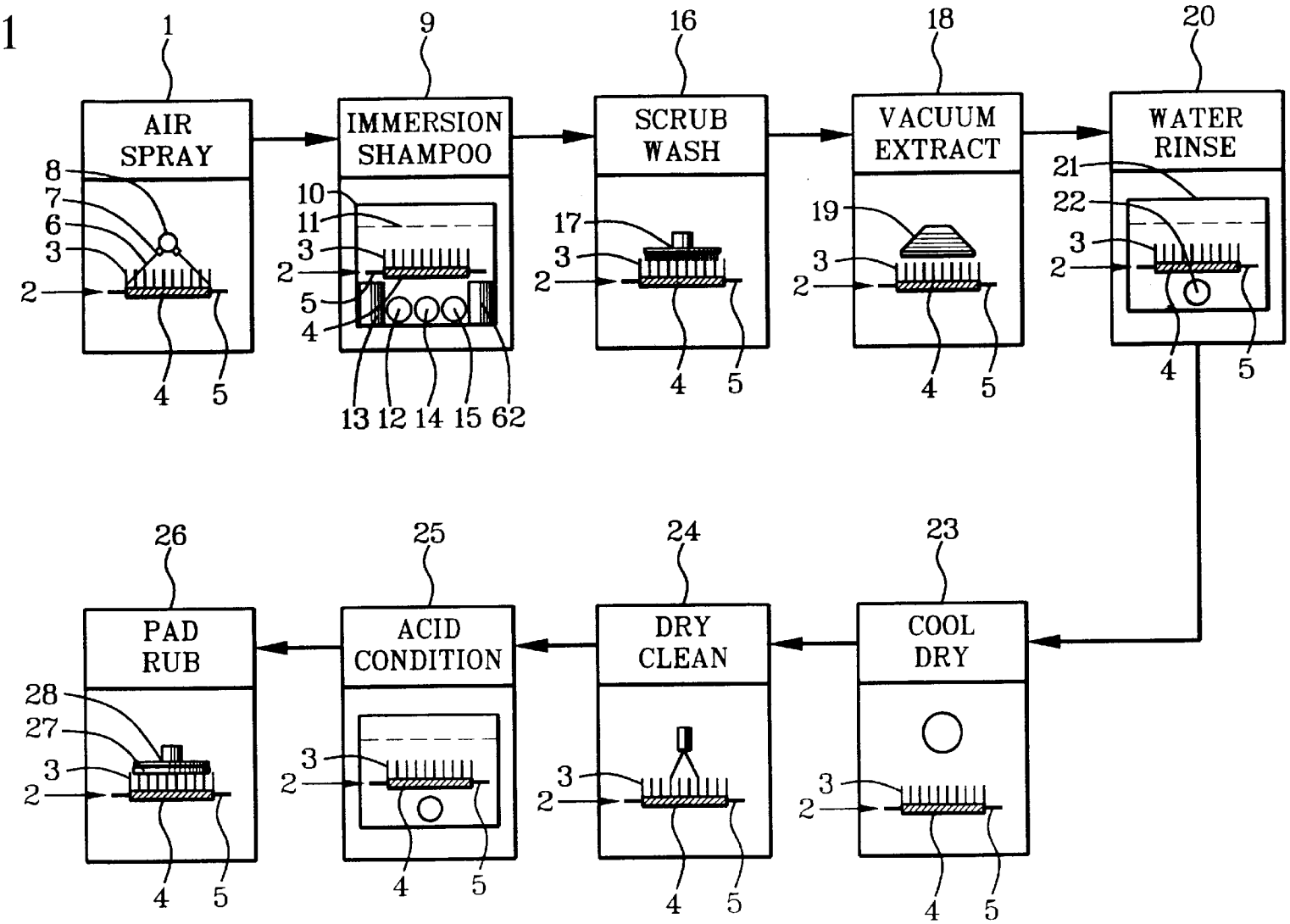
FIG. 1 is a flow diagram of the method with schematic representations of steps of the method.

Referring first to the flow diagram with schematic representation of this rug-cleaning method in FIG. 1, a first step is designated as air spray 1 for removing dry-extractible dirt from a rug 2 having nap 3 on backing 4 and generally fringes 5. Sprays of air 6 are shown as being directed at approximately forty-five degrees from verticality of the nap 3 from nozzles 7 at optionally both sides of a nozzle tube 8, but can be directed from only one side of nozzle tubes 8 for some applications.

Unique advantages of air spray 1 as the first step include removal of particulate contamination that could spread to other parts of a rug and to other rugs if wet before being removed. In addition, dry particulate contamination consumes additional cleaning fluid and requires different types of cleaning agents for effectiveness than for dirt that can not be removed readily in dry form.

The sprays of air 6 are directed from the nozzles 7 at approximately thirty-to-fifty degrees from verticality of the nap 3 in order to best reach under dry dirt and to protect the backing 4 from damage with a more direct angle. Pressure of air from the nozzles 7 is ninety to one hundred forty psi, as appropriate for structure of particular predetermined area rugs 2.

The sprays of air 6 are directed from at least two opposite sides of the nap 3 in order to remove dirt from all around separate strands of nap 3. This can be accomplished by directing the sprays of air 6 from a single side of a nozzle tube 8 that is rotated approximately ninety degrees between a first and a second orientation angle of the nozzles 7. Optionally, the nozzle tubes 8 can have nozzles 7 at both sides for being moved over the nap 3 for angular spraying oppositely from-side-to-side of the nap 3.

A second step is designated immersion shampoo 9 for removing immersion-extractible dirt with immersion-shampooing. For immersion-shampooing, the rug 2 is immersed in a shampoo tank 10 below a shampoo-liquid line 11 where shampoo liquid is added with an inlet conveyance 12, circulated with a circulator 13, agitated with shampoo jets from an agitator tube 14 and drained for replacement by a drain conveyance 15 and strained by a strainer 62 as appropriate for predetermined area rugs 2. Immersion-shampooing avoids physical contact of objects such as scrubbers with the nap 3 and the backing 4. The fringes 5, however, can be scrubbed or otherwise washed aggressively as appropriate for the predetermined area rugs 2 in relation to the immersion-shampooing.

A third step is designated scrub wash 16 for aggressively scrubbing the nap 3 and the fringes 5 as appropriate for removing adhered dirt such as stains, odors, urine and oil after removal of cleaning obstruction by dry-removable and immersion-removable contaminants. Then, cleaning agents that are particularly designed for absorbed and adhered dirt can be used effectively with scrubbing equipment such as a rotary scrubbing brush 17.

A fourth step is designated vacuum extract 18 for removing wash fluid, foam and dirt with preferably an extractor vacuum 19.

A fifth step is designated water rinse 20 for water rinsing of the rug 2 with preferably clean water in a rinse tank 21 having a rinse-water conveyance 22. A spray or hose rinse can be used as an option.

A sixth step is designated cool dry 23 for cool drying at approximately 70 to 75 degrees Fahrenheit. Cool drying can be hanging on racks for a curing period or blow drying with high volumes of air and dehumidification similar to spraying with air as described in relation to air spray 1.

A seventh step is designated dry clean 24 for dry cleaning to remove types of adhered dirt, stains and odors that are not removable fully with washing. Spray dry cleaning is preferred. Immersion dry cleaning is optional.

An eighth step is designated acid condition 25 for conditioning with an catalyst to counteract or neutralize any residue of base substances in washing and dry-cleaning agents. This also can be accomplished optionally by spraying or immersion.

A ninth step is designated pad rub 26 for rubbing the nap 3 with preferably a cloth pad 27 treated in an acid-based catalyst on a rotational rubbing machine 28.

Figure 2:
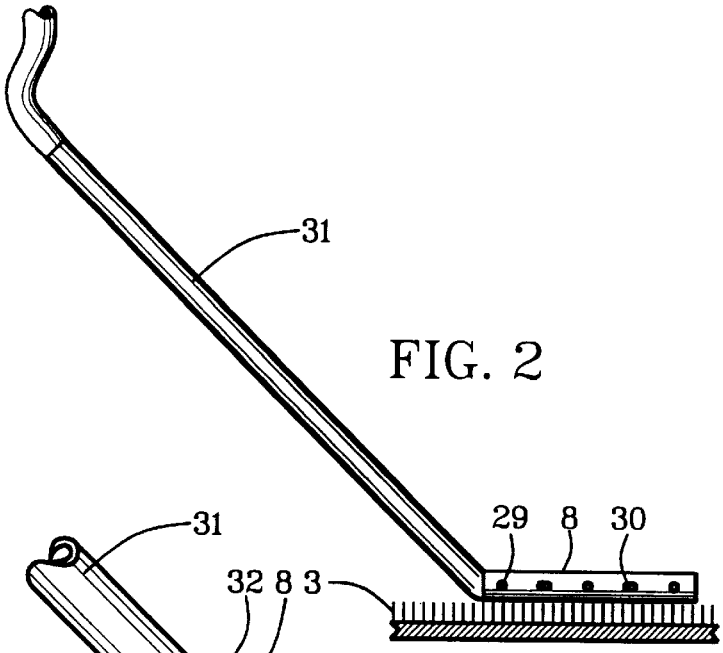
FIG. 2 is a side elevation view of a manual nozzle tube showing nozzle orifices for direction of air spray at angles to verticality of rug nap.
Figure 3:
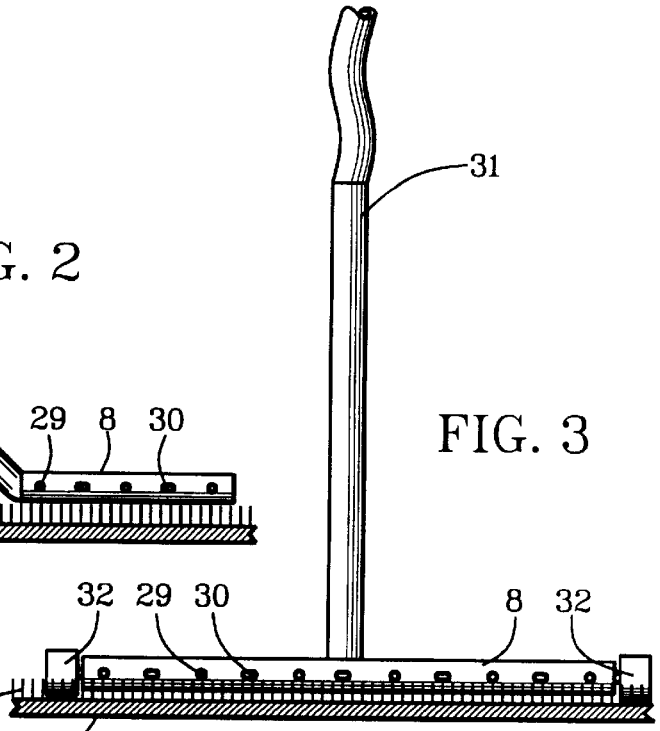
FIG. 3 is a front elevation view of a nozzle tube with wheels for either manual or automated machinery for a dry-extractible step of the method.
Figure 4:
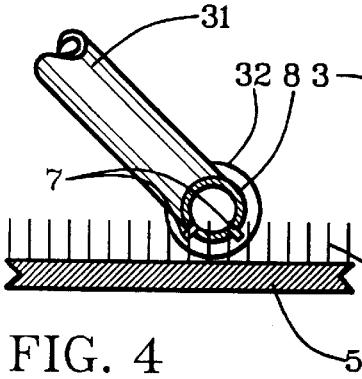
FIG. 4 is a partially cutaway end view of the FIG. 3 illustration.

Referring to FIGS. 1–4, the nozzles 7 are preferably a mix of roundness orifices 29 for controlled concentration of the sprays of air 6 and flatness orifices 30 for controlled flat sprays of air 6 from nozzle tubes 8 that can be supported by a slanted handle 31 as shown in FIG. 2 and/or that can be supported by nozzle-tube wheels 32 as shown in FIGS. 3–4. The nozzles 7 can be positioned on both sides of the nozzle tube 8 as shown in FIG. 4 or on one side as shown in FIG. 2.

Figure 5:
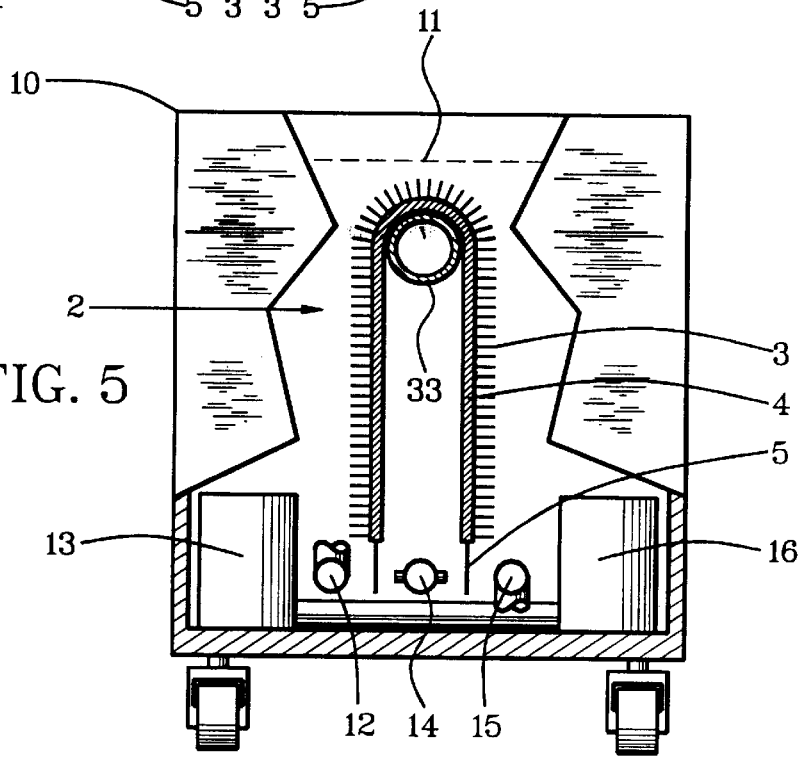
FIG. 5 is a partially cutaway end view of an immersion-shampoo tank with features for both manual and automated application of this method.
Figure 6:
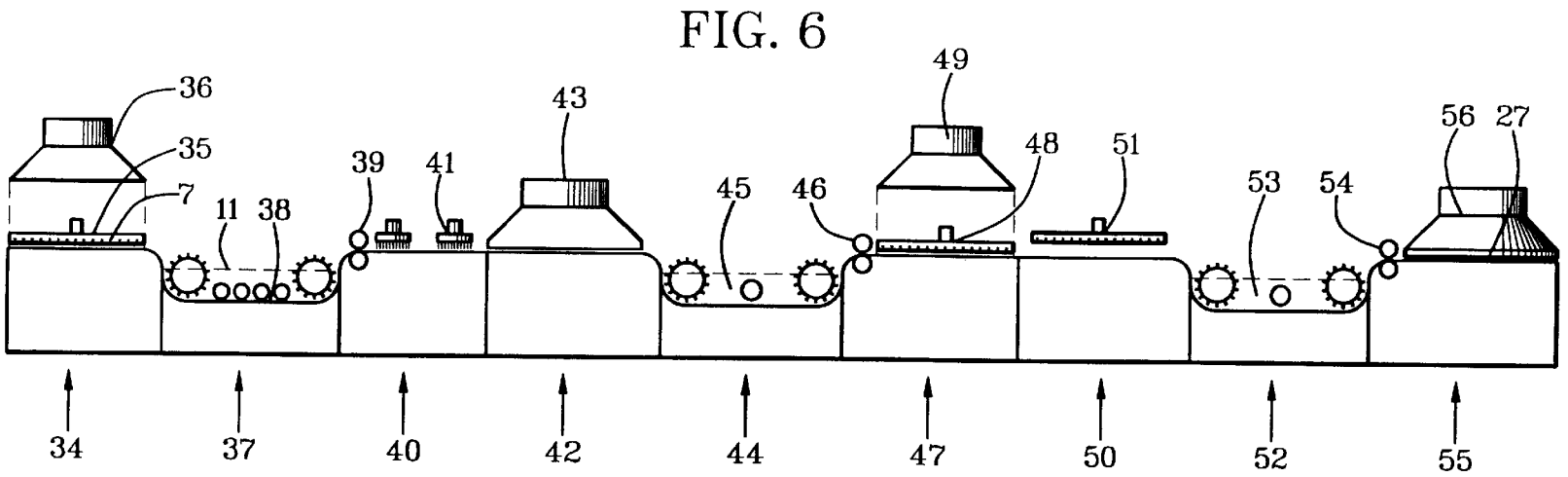
FIG. 6 is a side view of a schematic representation of an automated application of this area-rug cleaning method.

Referring to FIGS. 1 and 5, the shampoo tank 10 can have a tank rack 33 on which to suspend rugs 2 below the shampoo-liquid line 11 while being immersion-shampooed as described in relation to FIG. 1.

Referring to FIGS. 1–8, this area-rug cleaning method can be applied with relatively manual equipment or relatively automated machinery, neither of which are intended to be described in detail for purposes of being claimed in this document. FIGS. 2 and 5 illustrate relatively manual equipment. FIGS. 3–4 and 6–8 illustrate relatively automated machinery that is implied also in the description in relation to FIG. 1.

Relatively automated machinery can include sections for cleaning of rugs 2 progressively with this area-rug cleaning method. The air spray 1 can be accomplished in an air-spray section 34 having automated nozzle tubes 35 that can extend lengths or widths of the air-spray section 34 and be provided with a vacuum hood 36 for removing dirt blown away by air from the nozzles 7.

The immersion shampoo 9 can be accomplished in a shampoo section 37 having conveyance of part or full lengths of rugs 2 progressively through an automated immersion tank 38 with the same shampooing features as described for FIGS. 1 and 5 and having a shampoo wringer 39 at a terminal end.

The scrub wash 16 can be accomplished in a scrub-wash section 40 having conveyance of rugs 2 under automated scrubbers 41 that are preferably rotational as described for FIG. 1.

The vacuum extract 18 can be accomplished in a vacuum section 42 having conveyance of rugs 2 under an automated vacuum 43.

The water rinse 20 can be accomplished in a water-rinse section 44 having conveyance of rugs 2 through an automated rinse tank 45, followed by a water-rinse wringer 46.

The cool dry 23 can be accomplished in a cool-dry section 47 having conveyance of rugs 2 under and/or through an automated blow-dryer 48 using high volume of air provided by air movers as used for drying.

The dry clean 24 can be accomplished in a dry-clean section 50 having conveyance of rugs 2 under and/or through an automated dry cleaner 51 which can have either a sprayer or an immersion tank.

The acid condition 25 can be accomplished in an acid-condition section 52 having conveyance of rugs 2 through an automated conditioner tank 53 which can be followed by a conditioning wringer 54.

The pad rub 26 can be accomplished in an pad-rub section 55 having conveyance of rugs 2 under an automated rubbing machine 56 onto which cloth pads 27 are positioned for rotational rubbing.

Figure 8:
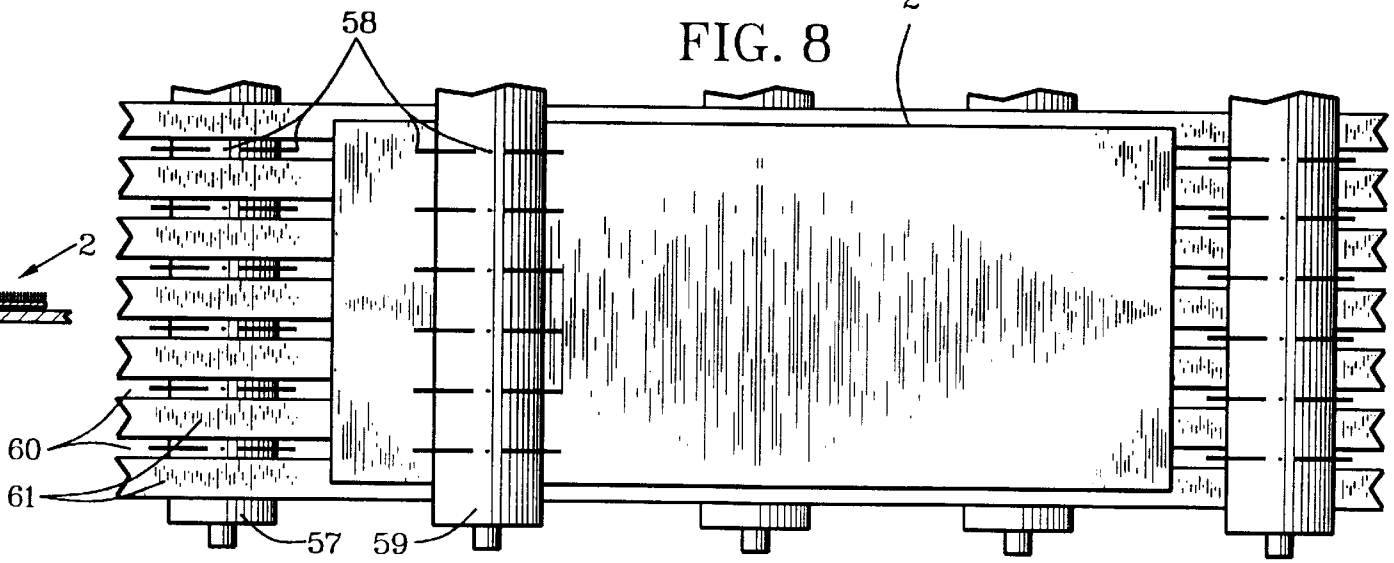
FIG. 8 is a partially cutaway top view of the rug-conveyance system of the FIG. 7 illustration.
Figure 7:
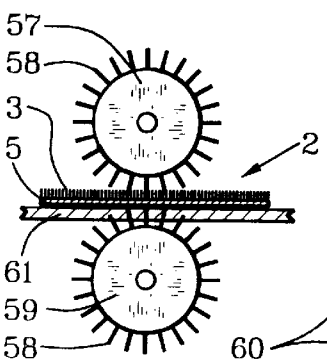
FIG. 7 is a partially cutaway side view of a section of a rug-conveyance system for the automated application of this area-rug cleaning method.

Shown in FIGS. 7–8 for rug conveyance are recommended components which include a top roller 57 having roller fingers 58 with predetermined resilience and softness in combination with a bottom roller 59 having roller fingers 58. The top roller 57 and the bottom roller 59 rotate in opposite directions with the roller fingers 58 having predetermined extension through elongate spaces 60 between rug-support belts 61 that can travel linearly to convey area rugs 2 in cooperation with the rollers 57 and 59. Appropriate positioning, sizing, and shaping of these components can be provided for the sections of the relatively automated machinery shown in FIG. 6.

A new and useful area-rug cleaning method having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A method comprising the following steps for cleaning area rugs:

removing dry-extractible dirt with pressurized air;

removing immersion-extractible dirt with immersion-shampooing;

removing adhered dirt such as stains, odors and urine with scrub washing;

removing wash fluid with dry extraction;

water rinsing;

cool drying;

dry cleaning;

conditioning with an acid-based catalyst; and rubbing nap of the area rugs with a cloth pad.

2. A method as described in claim 1 wherein:

the pressurized air is directed against nap of the area rugs at predetermined angles from nozzles having outlet orifices for predetermined direction of air spray.

3. A method as described in claim 2 wherein:

the pressurized air has pressure that is variable between ninety and one hundred forty psi selectively for predetermined area rugs;

the predetermined angles are intermediate approximately fifty degrees and thirty degrees from at least two oppositely disposed sides of verticality of the nap selectively for the predetermined area rugs; and the outlet orifices have predetermined sizes, shapes and axial directions selectively for the predetermined area rugs.

4. A method as described in claim 3 wherein:

the predetermined angles are variable by varying rotational orientation of a nozzle tube on which the nozzles are positioned with axes at predetermined angles from a single side of an axis of the nozzle tube.

5. A method as described in claim 3 wherein:

the predetermined angles are variable by varying rotational orientation of the nozzle tube on which the nozzles are positioned with axes at predetermined angles from oppositely disposed sides of the axis of the nozzle tube.

6. A method as described in claim 3 wherein:

the predetermined sizes, shapes and axial directions of the outlet orifices have flatness for flat spray and roundness for round spray selectively for the predetermined area rugs.

7. A method as described in claim 1 wherein:

the pressurized air used for removing dry-extractible dirt is removed by vacuum suction after the dry-extractible dirt has been mixed with the pressurized air and after the pressurized air has been at least partially expended to ambient pressure.

8. A method as described in claim 1 wherein:

the immersion-shampooing is accomplished by circulation, agitation, straining and replacement of a liquid shampoo solution selectively in a container of shampoo in which at least a portion of at least one rug is positioned.

9. A method as described in claim 8 wherein:

scrubbing and rubbing contact of fringes of the predetermined area rugs is applied selectively during the immersion-shampooing.

10. A method as described in claim 1 wherein:

the removing of adhered dirt is accomplished with preferably rotational scrubbers while applying detergent solution selected from classes and types of cleaning agents for removal of relatively adherent contaminants such as urine, food stains, rust and oils.

11. A method as described in claim 1 wherein:

dry extraction for removing wash fluid is accomplished preferably with vacuum suction.

12. A method as described in claim 1 wherein:

water rinsing includes clean-water rinsing of tops, bottoms and fringes of the area rugs.

13. A method as described in claim 1 wherein:

the cool drying is accomplished at approximately 70 to 75 degrees Fahrenheit without repeatedly bending the area rugs.

14. A method as described in claim 1 wherein:

the cool drying is blow drying the nap of the area rugs selectively as appropriate for the predetermined area rugs.

15. A method as described in claim 1 wherein:

the dry cleaning is low-moisture dry cleaning.

16. A method as described in claim 15 wherein:

the low-moisture dry cleaning is spray-on dry cleaning.

17. A method as described in claim 1 wherein:

the rubbing with a cloth pad is accomplished preferably with cloth padding on at least one rotational rubbing device.

18. A method comprising the following steps for cleaning area rugs:

blow-dusting nap of the area rugs with compressed air having predetermined pressure directed from angles of 30 to 50 degrees from oppositely disposed sides of perpendicularity of the nap selectively for predetermined area rugs;

washing, rinsing and cool drying the area rugs selectively as appropriate for the predetermined area rugs; and dry cleaning the area rugs selectively as appropriate for the predetermined area rugs.

19. A method as described in claim 18 wherein:

the washing has a first step of immersion-shampooing and a second step of scrubbing the area rugs as appropriate for the predetermined area rugs.

20. A method as described in claim 18 and further comprising the additional step of rubbing the nap after dry cleaning of the area rugs as appropriate for the predetermined area rugs.

21. A method as described in claim 18 wherein:

the cool drying is blow drying the nap of the area rugs selectively as appropriate for the predetermined area rugs.

22. A method as described in claim 18 and further comprising the additional step of blow drying nap after dry cleaning of the area rugs as appropriate for the predetermined area rugs.

23. A method comprising the following steps for cleaning area rugs:

blowing rug nap of an area rug angularly with compressed air to remove dry-extractible dirt;

immersion-shampooing the area rug to remove immersion-extractible dirt;

scrub-washing the rug nap to remove stains, odors and other adhered dirt;

vacuuming all surfaces of the rug with a vacuum extractor;

water-rinsing the entire rug;

drying the rug at approximately 70 to 75 degrees Fahrenheit;

spray-dry cleaning with water-miscible solvent to remove chemically adhered dirt;

conditioning with an acid-based cleaning catalyst; and rubbing with clean, dry padding.

* * * * *